US006947003B2

(12) United States Patent
Huor

(10) Patent No.: US 6,947,003 B2
(45) Date of Patent: Sep. 20, 2005

(54) SLOT ARRAY ANTENNA

(75) Inventor: Ou Hok Huor, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/455,789

(22) Filed: Jun. 6, 2003

(65) Prior Publication Data

US 2004/0066346 A1 Apr. 8, 2004

(30) Foreign Application Priority Data

Jun. 6, 2002 (JP) ..... 2002-152602
Jun. 6, 2002 (JP) ..... 2002-165823

(51) Int. Cl.[7] ..... H01Q 13/10
(52) U.S. Cl. ..... 343/770; 343/872
(58) Field of Search ..... 343/767, 770, 343/771, 872, 879

(56) References Cited

U.S. PATENT DOCUMENTS 4,760,402 A * 7/1988 Mizuno et al. ..... 343/713
5,218,368 A * 6/1993 Huruno et al. ..... 343/700 MS
5,528,249 A * 6/1996 Gafford et al. ..... 343/704
5,596,337 A * 1/1997 Merenda ..... 343/770
5,936,579 A * 8/1999 Kapitsyn et al. ..... 343/700 MS
6,411,258 B1 * 6/2002 Ho ..... 343/700 MS

FOREIGN PATENT DOCUMENTS

JP 58-181303 10/1983
JP 10-303638 11/1998
JP 2004147169 A * 5/2004 ..... H01Q/21/06

* cited by examiner

*Primary Examiner*—Shih-Chao Chen
(74) *Attorney, Agent, or Firm*—Rabin & Berdo, P.C.

(57) ABSTRACT

A slot array antenna comprises a slot array antenna main body (111) and a dielectric cover (116). The slot array antenna main body (111) has a slot plate (113). A main beam (115) having radiation directivity, extending in a direction inclined a tilt angle θ alone from a direction normal to a plane P1 of the slot plate (113) is set to the slot array antenna main body (111). The dielectric cover (116) has an inclination angle α formed by an outer plane P3 and an inner plane P4 and is comprised of a dielectric material having a refractive index n. The inner plane P4 of the dielectric cover (116) is provided so as to oppose to the slot plate (113) of the slot array antenna main body (111). Thus, the main beam (115) having the radiation directivity is transmitted through and refracted by the dielectric cover (116), so that the tilt angle θ is corrected to allow the main beam to extend in a direction orthogonal to the outer plane P3 of the dielectric cover (116).

22 Claims, 13 Drawing Sheets

SLOT ARRAY ANTENNA

BACKGROUND OF THE INVENTION

1. Field of the Invention

The present invention relates to a slot array antenna comprising a plurality of element antennas and including a slot plate having a plurality of slots.

2. Description of the Related Art

An array antenna is of an antenna wherein a plurality of element antennas are disposed in predetermined patterns and having characteristics unobtainable by a single antenna. Controlling the phase of each of the element antennas constituting the array antenna makes it possible to control directivity of the whole array antenna. Accordingly, the array antenna can be utilized even as a beam scan antenna without mechanically activating an array antenna main body.

With remarkable development of wireless communication technologies, frequency bands assigned to various communication apparatuses have been prone to fall short in recent years. In order to make up for it, the effective use of frequencies and the development of technology necessary for shifting to higher frequencies have been imperative. For example, a millimeter wave, which has heretofore been virtually used only for a basic research, has been used in an Intelligent Transport System (ITS). Millimeter wave related communication devices have been expected to be used in car societies like Japan and the U.S and Europe as explosive as home appliances in the near future.

In the field of such millimeter wave communications, it is considered that the use of the millimeter wave becomes essential to various parts and devices. One most-valued device that bears the millimeter wave communications, is of an antenna. The antenna is necessary to transmit and receive a millimeter-wave signal and essential to the millimeter wave communications. Research organizations and makers around the world, which have taken part in the research and development of the millimeter wave communications, are now developing a high-performance millimeter wave antenna in competition with one another. Millimeter wave antennas, which have heretofore been developed, vary widely in terms of configurations. Of these, a slot array antenna is known as a millimeter wave antenna considerably excellent in characteristic.

The slot array antenna is an array antenna wherein as its name implies, slot antennas are disposed in predetermined patterns as element antennas. By determining dimensions and layouts of the respective device slot antennas, desired electric-field distributions can be obtained within predetermined areas. For example, a plurality of slot antennas are two-dimensionally disposed in a square area so that a uniform electric-field distribution related to the direction, phase and amplitude can be obtained. Such an antenna is theoretically nearly identical in radiation characteristic to an apature antenna having a uniform electric-field distribution but is superior to it in terms of the degree of freedom of its configuration and the uniformity of an electric-field distribution.

Disposing the slot array antennas in parallel makes it possible to obtain a widespread and two-dimensional slot array antenna. Such a two-dimensional slot array antenna (hereinafter called simply a "slot array antenna") has been researched and developed in respective locations. This has been confirmed even experimentally as well as theoretically as one high-gain antenna as will be described in the following reference.

"Prototype Characteristics of Waveguide Slot Array Having 76.5 GHz Low Sidelobe Layer Structure" (Society Conference of the Institute of Electronics, Information and Communication Engineers, March, 2000, B-1-130).

It is common to normally allow a center frequency to have a predetermined bandwidth when it is desired to design a slot array antenna. Namely, if an actually used frequency falls within a predetermined range even if it deviates from a set center frequency, then radiation directivity, an impedance characteristic and a reflection characteristic or the like of the antenna are not degraded. If the frequency falls within a predetermined frequency range with respect to the center frequency, then the frequency can be used. This frequency range (width) is called a "bandwidth". In general, the more the bandwidth of this frequency is broadened, the more the antenna is evaluated. However, it is not possible to easily broaden the bandwidth.

On the other hand, the bandwidth can be broadened to some extent by allowing a main beam of the radiation pattern of the slot array antenna to have a predetermined angle. The main beam having the radiation directivity of the slot array antenna becomes essentially normal to a slot plate of the slot array antenna. However, if the antenna is designed so that the main beam having the radiation directivity is tilted a few degrees (this angle is called a "tilt angle") from the direction normal to the slot plate in a slot's longitudinal direction, then the bandwidth can be broadened to a predetermined degree.

However, when the main beam having the radiation directivity has the tilt angle, this will cause inconvenience when the slot array antenna is used for transmission or reception. Namely, while the main beam having the radiation directivity is directed to a target to carry out transmission and reception of an electromagnetic wave, the slot plate does not face in the direction orthogonal to the direction of its transmission/reception. Therefore, a considerable needless space is produced when the antenna is mounted to a transciever. If the direction of the main beam of the antenna is not adjusted, then a lot of trouble is taken over this adjustment.

SUMMARY OF THE INVENTION

The invention of the present application aims to provide a slot array antenna of such a type that a main beam of the radiation pattern is apparently set normal to a radiating surface of the antenna while holding a bandwidth of a frequency necessary for the slot array antenna therein.

In order to solve the above-described problems, a slot array antenna of the present invention comprises a slot array antenna main body and a dielectric cover.

A slot array antenna main body has a slot plate. A main beam of the radiation pattern, which extends in a direction inclined only a tilt angle $\theta$ from a direction normal to the plane of the slot plate, is set to the slot array antenna main body. A dielectric cover has an outer plane disposed substantially parallel to the plane of the slot plate. The dielectric cover has an inner plane forming an inclination angle $\alpha$ with the outer plane and is comprised of a dielectric material having a refractive index n. The inner plane of the dielectric cover is provided so as to be opposite to the slot plate of the slot array antenna main body. Thus, the electromagnetic wave is transmitted through and refracted by the dielectric cover, so that the tilt angle $\theta$ is corrected to allow the main beam to extend in a direction normal to the outer plane of the dielectric cover.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE PREFERRED EMBODIMENTS

On the occasion of the description of a slot array antenna of the present invention, a structure of an antenna main body will first be described.

Figure 2:
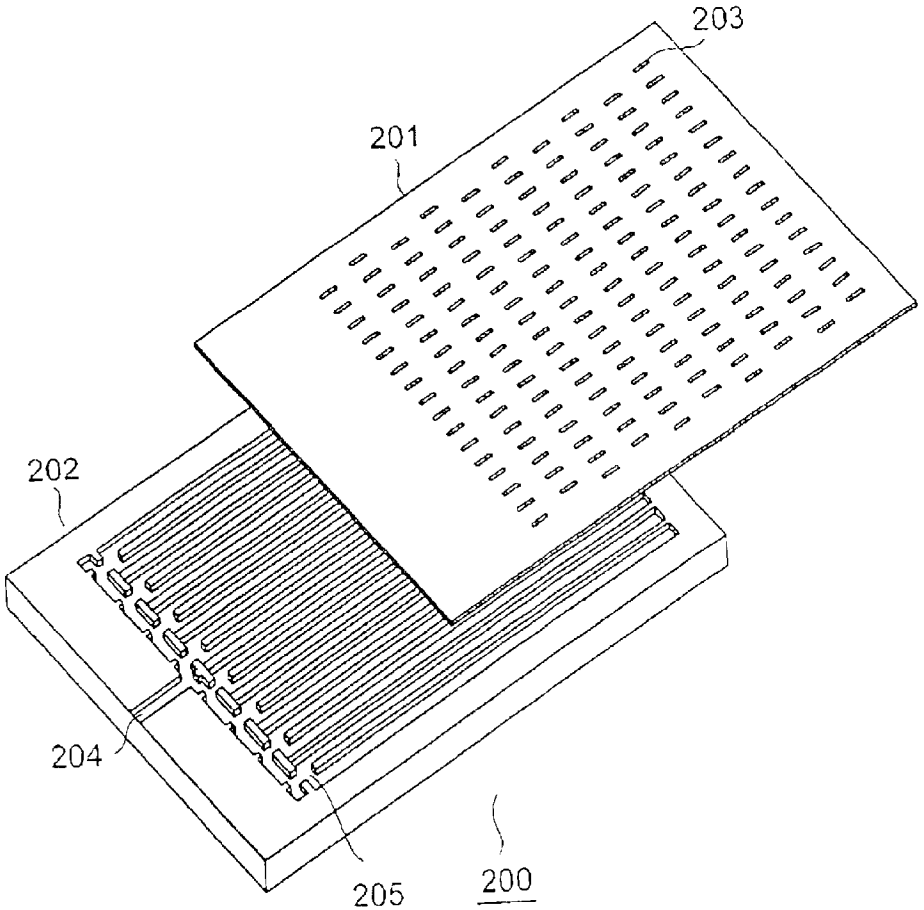
FIG. 2 is an exploded view of a slot array antenna.

FIG. 2 is a perspective view showing a main body of a slot array antenna. The slot array antenna main body is made up of a slot plate 201 and a wave guide plate 202 which serves as a waveguide. FIG. 2 shows a state in which the slot plate 201 and the wave guide plate 202 are in a separated state. The slot pate 201 is generally comprised of a thin conductive plate. A plurality of slots (cut openings) 203 are provided on the conductive plate. The wave guide plate 202 is provided with rectangular grooves 205 so that an input electromagnetic wave can be supplied from one feed port 204 defined on a thickish conductive plate to all the slots 203 provided on the slot plate 201. When the slot plate 201 and the wave guide plate 202 are bonded together so as to overlap each other, a row of the slots 203 can be formed on a wall of the waveguide placed in a line with the slot plate 201, so that the whole results in a slot array antenna 200.

As the electrical conductivity of the conductor or conductive plate used in each of the slot plate 201 and the wave guide plate 202 becomes high, an ohmic loss is low. This will contribute to a reduction in the loss of the antenna. Further, the accuracy of machining or processing of the slot plate 201 and the wave guide plate 202 and the accuracy of bonding of the two to each other will exert a strong influence on radiation characteristics of the antenna.

Figure 3:
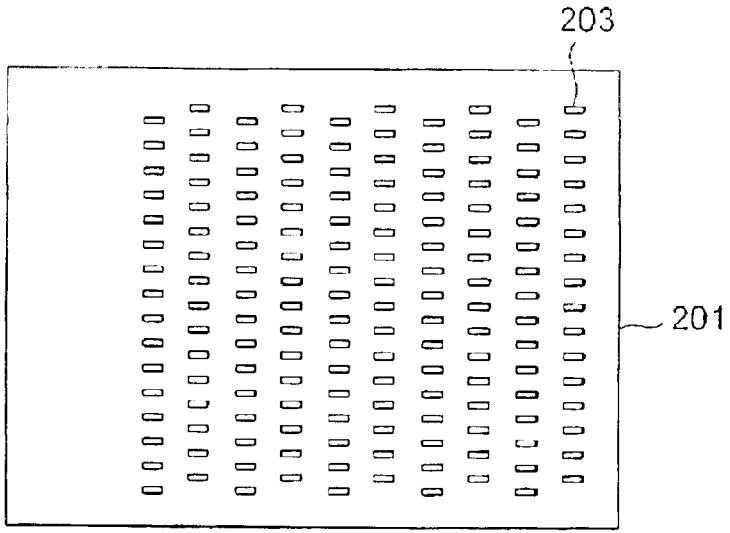
FIG. 3 is a plan view of a slot plate.

FIG. 3 is a plan view of the slot plate 201. While the shape of each slot 203 is basically rectangular, each of the slots 203 may be rounded at both ends for convenience of its machining. The length of the slot 203 is about one half the wavelength $\lambda$ of a radiating electromagnetic wave inputted to the waveguide, and the width thereof is about one-twentieth thereof. A center interval between the adjacent slots lying in the same row is approximately the same as a wavelength $\lambda g$ of the waveguide.

Figure 4:
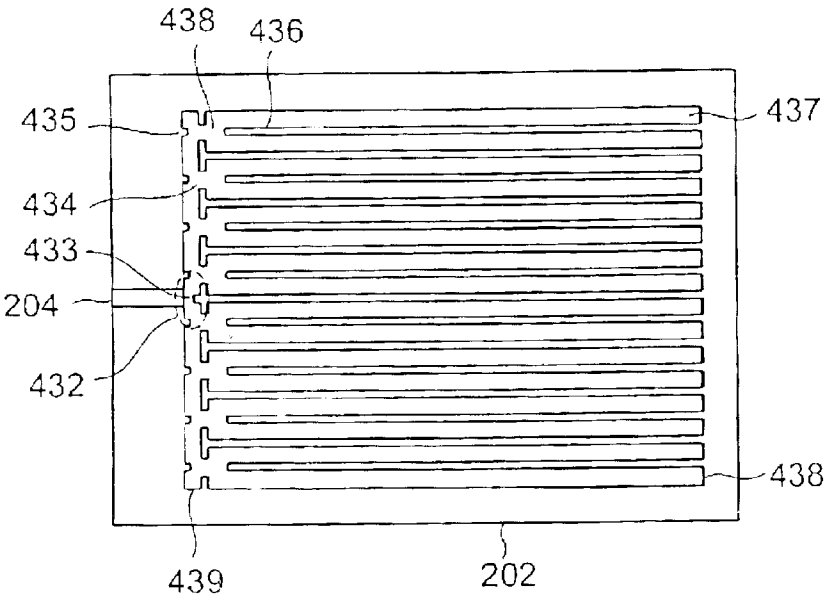
FIG. 4 is a flat view of a wave guide plate.

FIG. 4 is a plan view of the wave guide plate 202. A groove is provided so as to extend from the feed port 204 to the wave guide plate 202. This groove is introduced into a branch 432 surrounded by a dashed circle. This branch 432 results in an H-plane tee junction said in a microwave circuit element in a state in which the slot plate 201 and the wave guide plate 202 are being bonded to each other. An electromagnetic wave inputted from the feed port 204 is divided into inphase electromagnetic waves in half from side to side on a power basis at the H-plane tee junction 432. Here, a protrusion 433 is provided at a position where the electromagnetic wave strikes it as viewed from the feed port 204 at the H-plane tee junction 432. The protrusion 433 acts as a role of a matching post of the H-plane tee junction 432. Each of grooves 434 connected to the right and left of the H-plane tee junction 432 serves as a waveguide in the state in which the slot plate 201 and the wave guide plate 202 are being bonded to each other. This waveguide will now be called a "feed waveguide". Sine the feed waveguide 434 is symmetrical with respect to the axis line of the feed port 204, the description of a structure of the wave guide plate 202 will be made in terms of only one side thereof.

The feed waveguide 434 functions as a feed port for each of radiating waveguides 437, which sectional size is approximately the same as a cross section of each feed waveguide 434. A wall surface on the side opposite to each portion 438 corresponding to the feed port for the radiating waveguide 437 is provided with each of protrusions 435. The protrusion 435 acts as a role of a matching post in a manner similar to the protrusion 433. The distance from a leading end 439 of the feed waveguide 434 to a portion 438 corresponding to a final feed port is set to about one-fourth the guide wavelength λg to suppress a reflected wave. The electromagnetic wave inputted from each of the portions 438 corresponding to the respective feed ports is divided into two equal parts by its corresponding central wall 436, followed by supply to the two radiating waveguides 437. In the state in which the slot plate 201 and the wave guide plate 202 are being bonded to each other, a plurality of slots are disposed on their corresponding waveguide walls corresponding to the respective radiating waveguides 437, whereby an array antenna is obtained. Owing to such a structure, the number of the radiating waveguides 437 that constitute the slot array antenna, necessarily results in a multiple number of 4. Since the number of the radiating waveguides and the number of the slots on the walls of the respective radiating waveguides are also decided if a desired radiation characteristic and a usable frequency are determined, the dimensions of the whole antenna are also almost determined.

Figure 5:
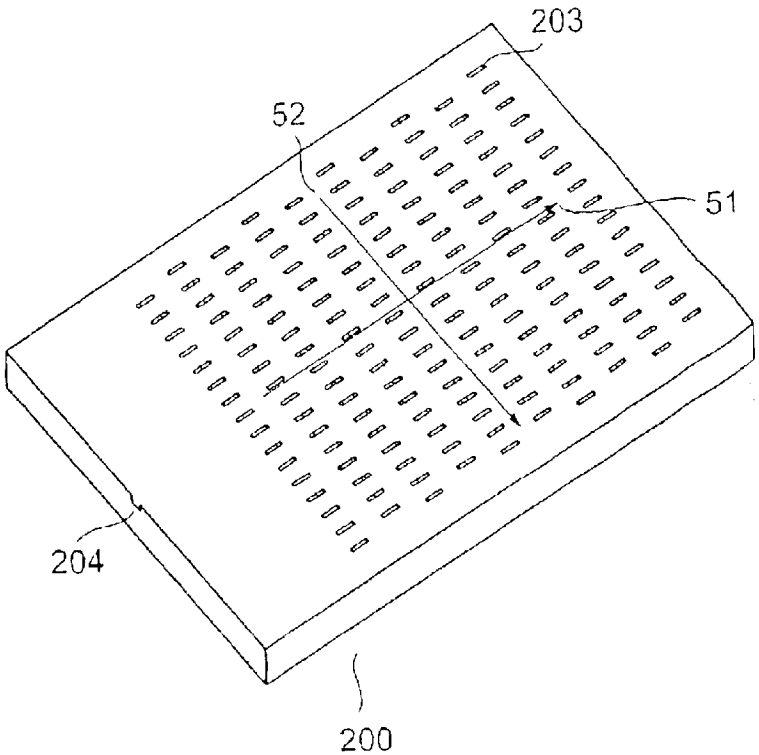
FIG. 5 is a perspective view useful for understanding polarization direction particular to the slot array antenna.

FIG. 5 is a perspective view showing the slot array antenna 200 subsequent to the bonding of the slot plate 201 and the wave guide plate 202 to each other. Since a mode of an electromagnetic wave in each radiating waveguide is given as a $TE_{10}$ mode, a magnetic-field direction 51 of the slot array antenna 200 results in a longitudinal direction of each slot, and an electric-field direction 52 thereof results in a transverse direction of each slot. Since all the slots 203 are disposed in the same direction, the electric-field direction in the neighborhood of the surface of the slot array antenna 200 results in substantially the same direction as the electric-field direction 52 except for the edge of the slot array antenna 200. Thus it can be said that the electric-field direction 52 of the slot array antenna 200 also results in the direction of its polarization.

Generally, since the principal of reciprocity can apply to all kinds of antenna, the transmission characteristics and receipt characteristics of an antenna are identical with each other. While the foregoing description has concentrated on transmission, the procedure shown and described is reversed in the case of receipt. Therefore, a description for the receipt is similar to the transmission, it will be omitted.

A main beam of the radiation pattern of a slot array antenna will next be explained.

Figure 6:
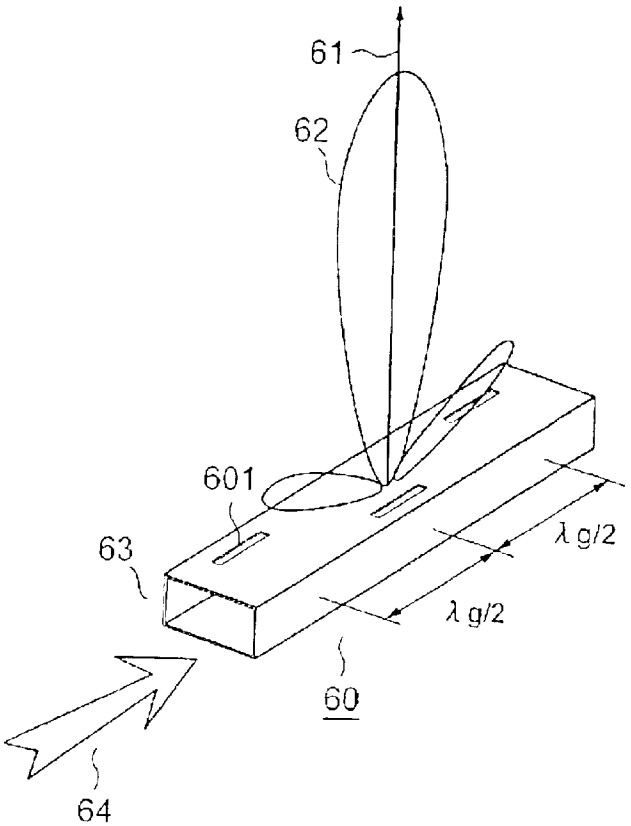
FIG. 6 is a view for describing a main beam (whose tilt angle: 0°) of the radiation pattern of a slot array antenna.

FIG. 6 is a view for describing the main beam having the radiation directivity of the slot array antenna. While it is shown using part of one radiating waveguide 60 herein, the radiation directivity actually corresponds to radiation directivity of the whole antenna. FIG. 6 shows radiation directivity having no tilt angle, i.e., a tilt angle of "zero". Here, a center interval between adjacent slots 601 becomes equal to a wavelength corresponding to one-half a guide wavelength λg of the radiating waveguide. In the slot array antenna shown in FIG. 6, a radiation directivity 62 is formed along a vertically-extending axis 61 of a slot plate. Namely, since the tilt angle of the main beam having the radiation directivity is "zero", the radiation directivity 62 becomes vertical to the slot plate. Incidentally, since a feed port 63 of the radiating waveguide 60 is provided in parallel with the slot plate, an input electromagnetic wave 64 is also inputted in parallel to the slot plate.

Figure 7:
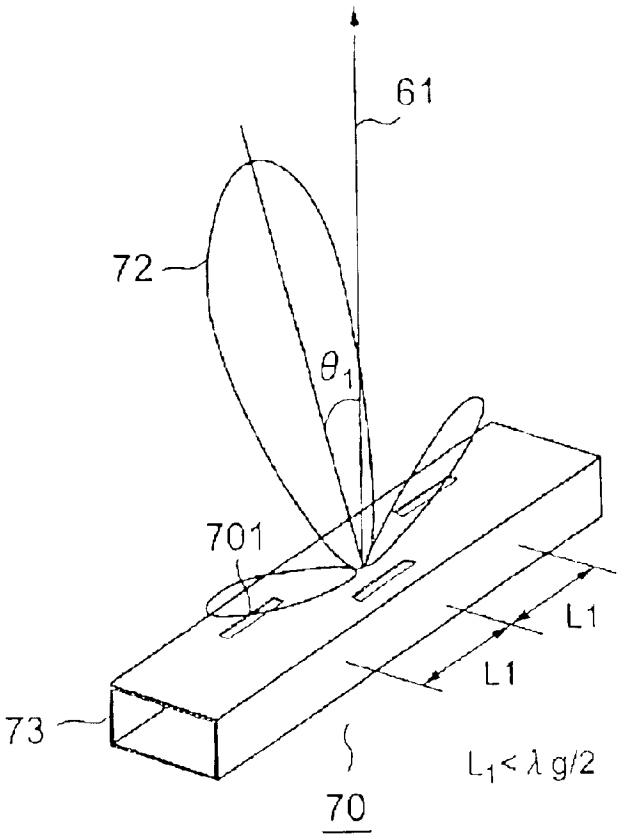
FIG. 7 is a view for describing a main beam (whose tilt angle is inclined to the feed port side) having radiation directivity of a slot array antenna.

FIG. 7 is a view for describing a main beam of the radiation pattern of a slot array antenna and shows a case in which the main beam is tilted to a feed port of a radiating waveguide by a tilt angle $\theta_1$. In a radiating waveguide 70 shown in FIG. 7, a center interval $L_1$ between adjacent slots 701 is smaller than 0.5 λg corresponding to one-half a guide wavelength λg. Incidentally, although not shown in the drawing, conditions for an input electromagnetic wave and the like are similar to FIG. 6. Since the center interval $L_1$ between the slots 701 is set smaller than 0.5 λg in this way, a radiation directivity 72 is tilted to the feed port 73 side by $\theta_1$ with respect to a direction 61 normal to a slot plate.

Figure 8:
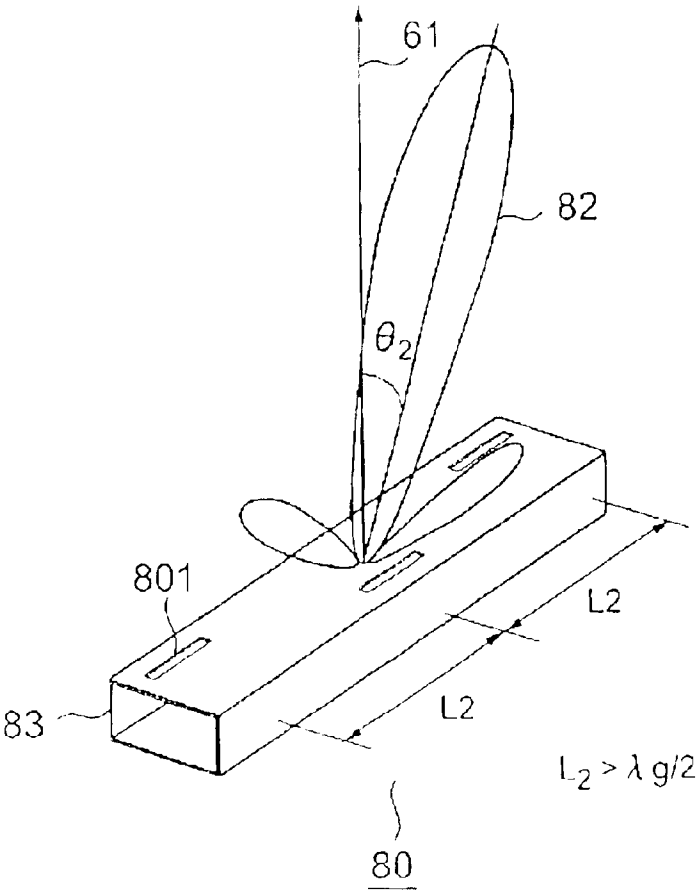
FIG. 8 is a view for describing a main beam (whose tilt angle is tilted to the side opposite to a feed port) having radiation directivity of a slot array antenna.

FIG. 8 is a view for describing a main beam of the radiation pattern of a slot array antenna and shows a case in which the main beam is tilted to the side opposite to a feed port of a radiating waveguide by a tilt angle $\theta_2$. In a radiating waveguide 80 shown in FIG. 8, a center interval $L_2$ between respective adjacent slots 801 is larger than 0.5 λg corresponding to one-half a guide wavelength λg. Incidentally, although not illustrated in the drawing, conditions for an input electromagnetic wave and the like are similar to FIG. 6. Since the center interval $L_2$ between the slots 801 is set larger than 0.5 λg in this way, a radiation directivity 82 is tilted to the side opposite to a feed port 83 by $\theta_2$ with respect to a direction 61 orthogonal to a slot plate.

In the above description, adjustments to the interval between the adjacent slots are made to suppress impedance mismatching in each radiating waveguide, which has been developed due to the occurrence of the tilt angle. Since the tilt angle is calculated in accordance with a predetermined equation, the center interval between the adjacent slots can be calculated based on the value of the tilt angle.

Preferred embodiments of the present invention will be explained with the aforementioned description as a premise.

Figure 1:
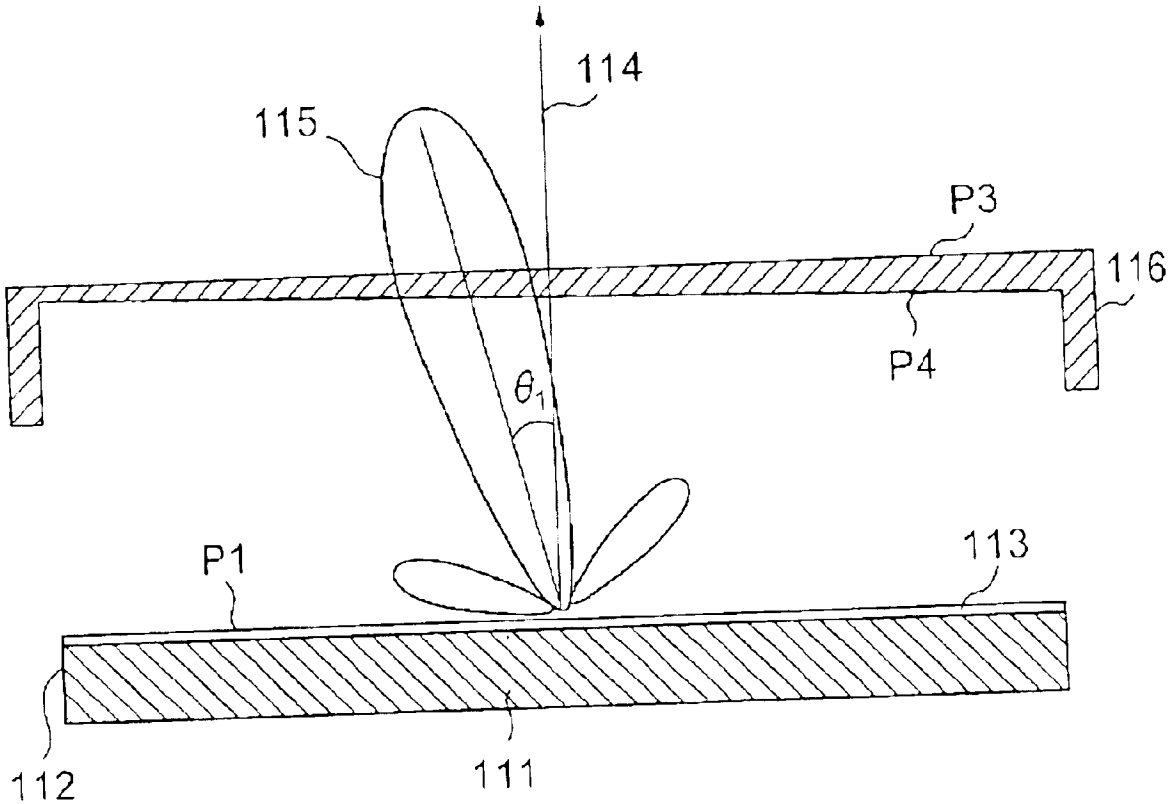
FIG. 1 is a view for describing a first embodiment of the present invention.
Figure 9:
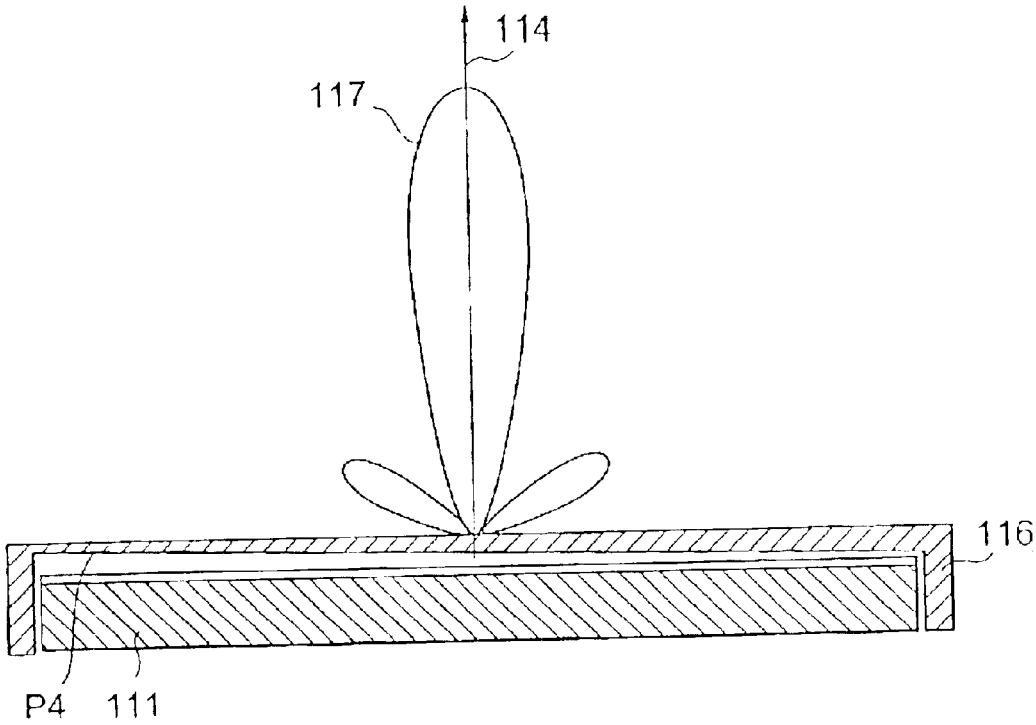
FIG. 9 is a view showing a state in which a dielectric cover is mounted to the slot plate side of a slot array antenna whose main beam has a tilt angle.
Figure 10:
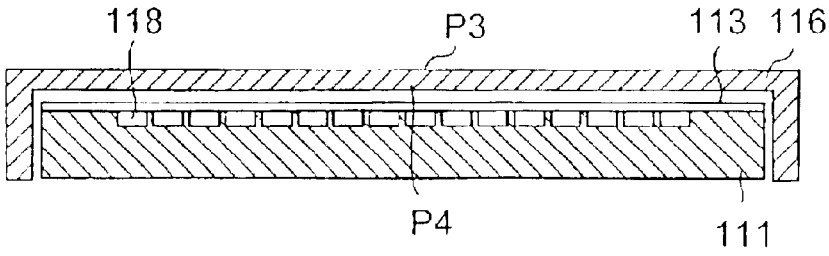
FIG. 10 is a cross-sectional view showing the slot array antenna according to the first embodiment of the present invention and the dielectric cover employed therein, which view includes cross sections of radiation waveguides.

FIG. 1 is a view for describing a first embodiment of the present invention. Incidentally, FIG. 1 shows a demounted state of a dielectric cover to make its description easy. FIGS. 9 and 10 are respectively views for describing a slot array antenna according to the first embodiment in a mounted state of the dielectric cover. In order to make an easy description, the present embodiment will be explained using FIG. 9 corresponding to a cross-sectional view taken along the axis of a radiating waveguide and FIG. 10 corresponding to a cross-sectional view including a cross section of the radiating waveguide.

In the slot array antenna according to the first embodiment of the present invention shown in FIG. 1, a main beam 115 having radiation directivity is tilted to the feed port 112 side of a radiating waveguide. A slot array antenna 111 in which the main beam 115 has a tilt angle $\theta_1$ with respect to a direction 114 normal to a slot plate 113 of the slot array antenna 111, and a dielectric cover (hereinafter called simply a "dielectric cover") 116 for correcting the tilt angle $\theta_1$ of the main beam 115 are shown in FIG. 1.

The dielectric cover 116 employed in the first embodiment is made up of a dielectric material low in loss in a frequency band of the slot array antenna 111 and allows an electromagnetic wave to pass therethrough without almost absorbing it. In other words, it is a material that does not substantially influence the electromagnetic wave. While the dielectric material has a dielectric constant $\in$, it reflects and refracts the electromagnetic wave when the electromagnetic wave is incident thereon. Therefore, the dielectric material is similar to the relationship between light and transparent glass. It is thus well known that many theorems handled in optics can be applied even to the electromagnetic wave and dielectric material as they are. If the dielectric constant of the dielectric cover is represented as $\in$ and a relative dielectric constant is given as $\in_r$, for example, then a refractive index n is substantially equal to a square root of $\in_r$. That is to say:

$$n=\sqrt{\in_r} \quad (1)$$

On the other hand, it is of an important point in the present invention that a phenomenon of refraction of the electromagnetic wave by the dielectric material is used to correct the tilt angle of the main beam having the radiation directivity. The dielectric cover 116 employed in the first embodiment basically comprises a plate-shaped dielectric having an outer plane P3 parallel to the surface of the slot plate 113 of the slot array antenna, i.e., a transmission/reception plane P1 of the antenna, and an inner plane P4 not parallel to the plane P1. The inner plane P4 of the dielectric cover 116 has a tilt angle $\alpha_1$ with respect to the outer plane P3. The tilt angle $\alpha_1$ is derived from the following equation:

$$\alpha_1=\arctan\{\sin\theta_1/(n-\cos\theta_1)\} \quad (2)$$

FIG. 9 shows a state in which a dielectric cover 116 is mounted to the slot plate side of a slot array antenna 111 in which a main beam has a tilt angle $\theta_1$. A radiation directivity 117 of the slot array antenna 111, which is refracted by an inner surface or plane P4 of the dielectric cover and has passed therethrough, extends in a direction 114 normal to a slot plate of the slot array antenna 111. Namely, a main beam 117 is pointed in a direction vertical to an outer plane P3 of the dielectric cover 116. Thus, the tilt angle of the main beam of the slot array antenna 111 apparently reaches about 0°, so that the tilt angle of the main beam may be treated as though it were eliminated or suppressed.

FIG. 10 is a cross-sectional view showing the slot array antenna 111 according to the first embodiment and the dielectric cover 116 employed therein, which view includes cross sections of radiating waveguides. An electromagnetic wave fed through each of the cross sections 118 of the radiating waveguides is radiated from each of unillustrated slots provided on the slot plate 113. While an outer plane P3 and an inner plane P4 of the dielectric cover 116 are seen as parallel in FIG. 10, the inner plane P4 actually forms a tilt angle $\alpha_1$ with respect to the outer plane P3 along the axis of each radiating waveguide as shown in FIG. 9.

The first embodiment described above shows an embodiment in which the main beam having the radiation directivity is tilted to the feed port side of the radiating waveguide and shows improvement countermeasures against the case shown in FIG. 7.

Figure 11:
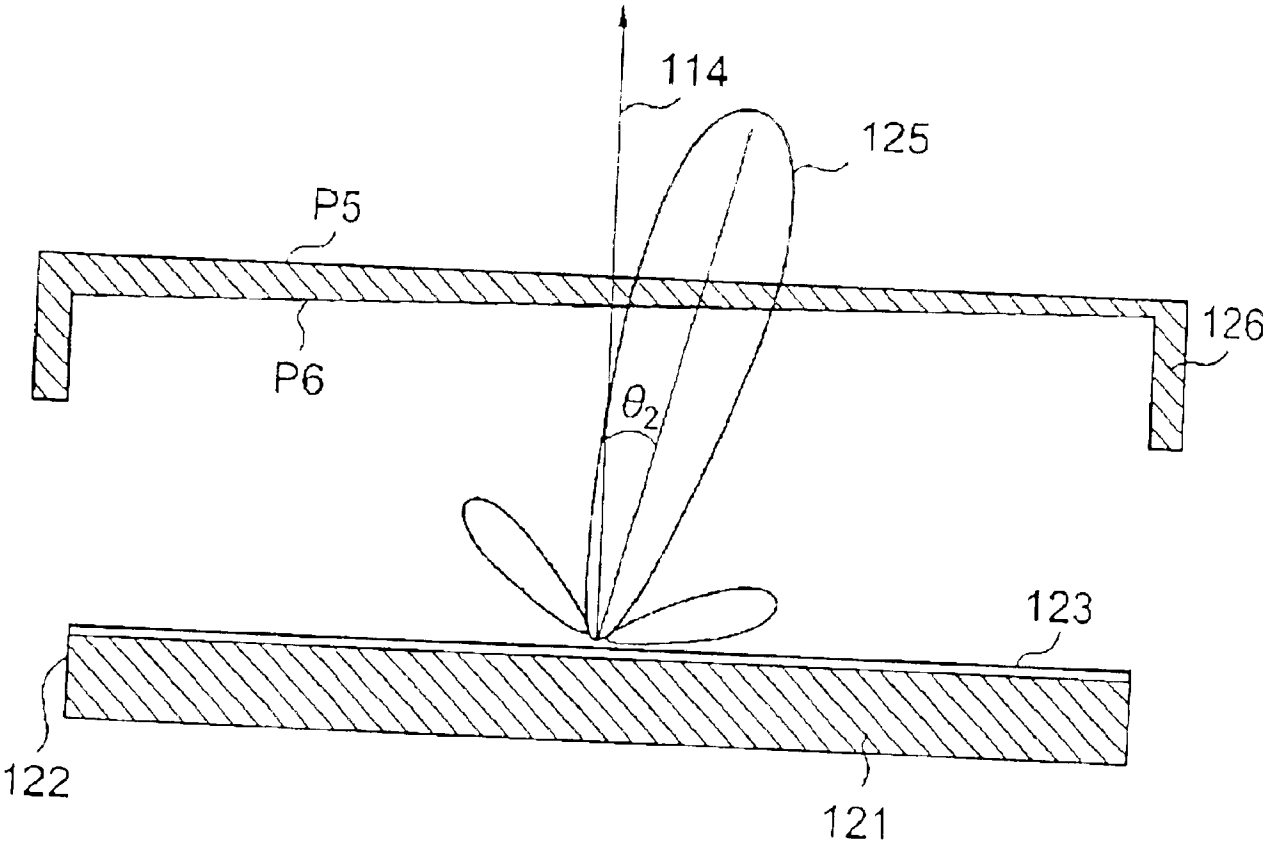
FIG. 11 is a cross-sectional view showing a slot array antenna of a second embodiment of the present invention and a dielectric cover employed therein.

FIG. 11 is a cross-sectional view showing a slot array antenna 121 according to a second embodiment of the present invention and a dielectric cover 126 employed therein. In the slot array antenna 121 according to the second embodiment shown in FIG. 11, a main beam 125 having radiation directivity is tilted to the side opposite to a feed port 122 of a radiating waveguide. The slot array antenna 121 in which the main beam 125 has a tilt angle $\theta_2$ with respect to a direction 114 normal to a slot plate 123 of the slot array antenna 121, and the dielectric cover 126 for correcting the tilt angle $\theta_2$ of the main beam 125 are shown in FIG. 11.

The second embodiment is also similar to the first embodiment in principle. Namely, when a relative dielectric constant of a dielectric material is represented as $\in_r$ in a usable frequency band, a refractive index n is substantially equal to a square root of $\in_r$ as indicated by the equation (1) even in the second embodiment.

On the other hand, the dielectric cover 126 employed in the second embodiment has also an outer plane P5 and an inner plane P6. The plane P6 has a tilt angle $\alpha_2$ with respect to the plane P5, and $\alpha_2$ is derived as represented by the following equation:

$$\alpha_2=\arctan\{\sin\theta_2/(n-\cos\theta_2)\} \quad (3)$$

Figure 12:
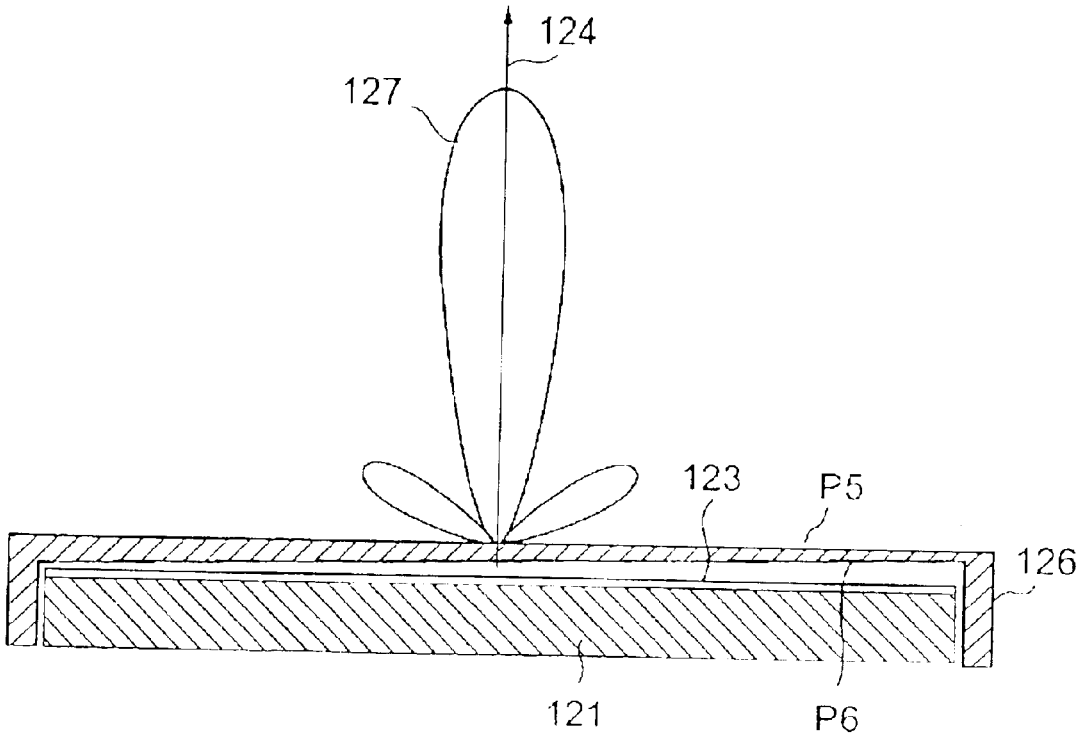
FIG. 12 is a view illustrating a state in which the dielectric cover is mounted to the slot plate side of the slot array antenna according to the second embodiment of the present invention.

FIG. 12 shows a state in which a dielectric cover 126 is mounted to the slot plate 123 side of a slot array antenna 121 in which a main beam has a tilt angle $\theta_2$. A radiation directivity 127 of the slot array antenna 121, which is refracted by an inner plane P6 of the dielectric cover 126 and has passed therethrough, is headed in a direction 124 vertical to an outer plane P5 of the dielectric cover 126. Namely, the main beam 127 is pointed in a direction vertical to the slot plate 123 of the slot array antenna 121. Thus, the tilt angle of the main beam of the slot array antenna 121 apparently reaches about 0°, so that the tilt angle of the main beam may be treated as though it were eliminated or suppressed.

Figure 13:
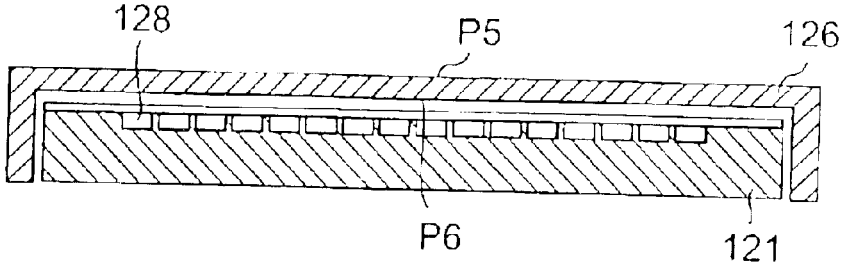
FIG. 13 is a cross-sectional view showing the slot array antenna of the second embodiment and a dielectric cover employed therein, which view includes cross sections of radiation waveguides.

FIG. 13 is a cross-sectional showing the slot array antenna 121 according to the second embodiment and the dielectric cover 126 employed therein, which view includes cross sections of radiating waveguides. FIG. 13 is shown in a manner similar to FIG. 10. In a manner similar to FIG. 10 even in this case, the inner plane P6 of the dielectric cover 126 actually forms a tilt angle $\alpha_2$ with respect to the outer plane P5 along the axis of each radiating waveguide as shown in FIG. 12.

The second embodiment is an embodiment in which the main beam having the radiation directivity is tilted to the side opposite to the feed port of the radiating waveguide and shows improvement countermeasures against the case shown in FIG. 8.

Since the aforementioned equations (2) and (3) respectively take a similar form, they can be summarized as the following equation (4):

$$\alpha=\arctan\{\sin\theta/(n-\cos\theta)\} \quad (4)$$

where $\theta$ indicates a tilt angle of a main beam of a slot array antenna, and $\alpha$ indicates an angle formed by an outer plane and an inner plane of a dielectric cover. In the first and second embodiments, the tilt angle $\theta$ ($=\theta_1=\theta_2$) of the main beam of the slot array antenna is 2.8°, and Teflon (trade name) is used as a material for the dielectric cover. A relative dielectric constant $\in_r$ is given as 2.7. According to the equation (1), since a refractive index n is equal to a square root of the relative dielectric constant $\in_r$, n=1.64. Thus, when an angular calculation is made using the equation (4), the angle $\alpha$ formed by the outer plane and the inner plane of the dielectric cover results in 4.36°.

Figure 14:
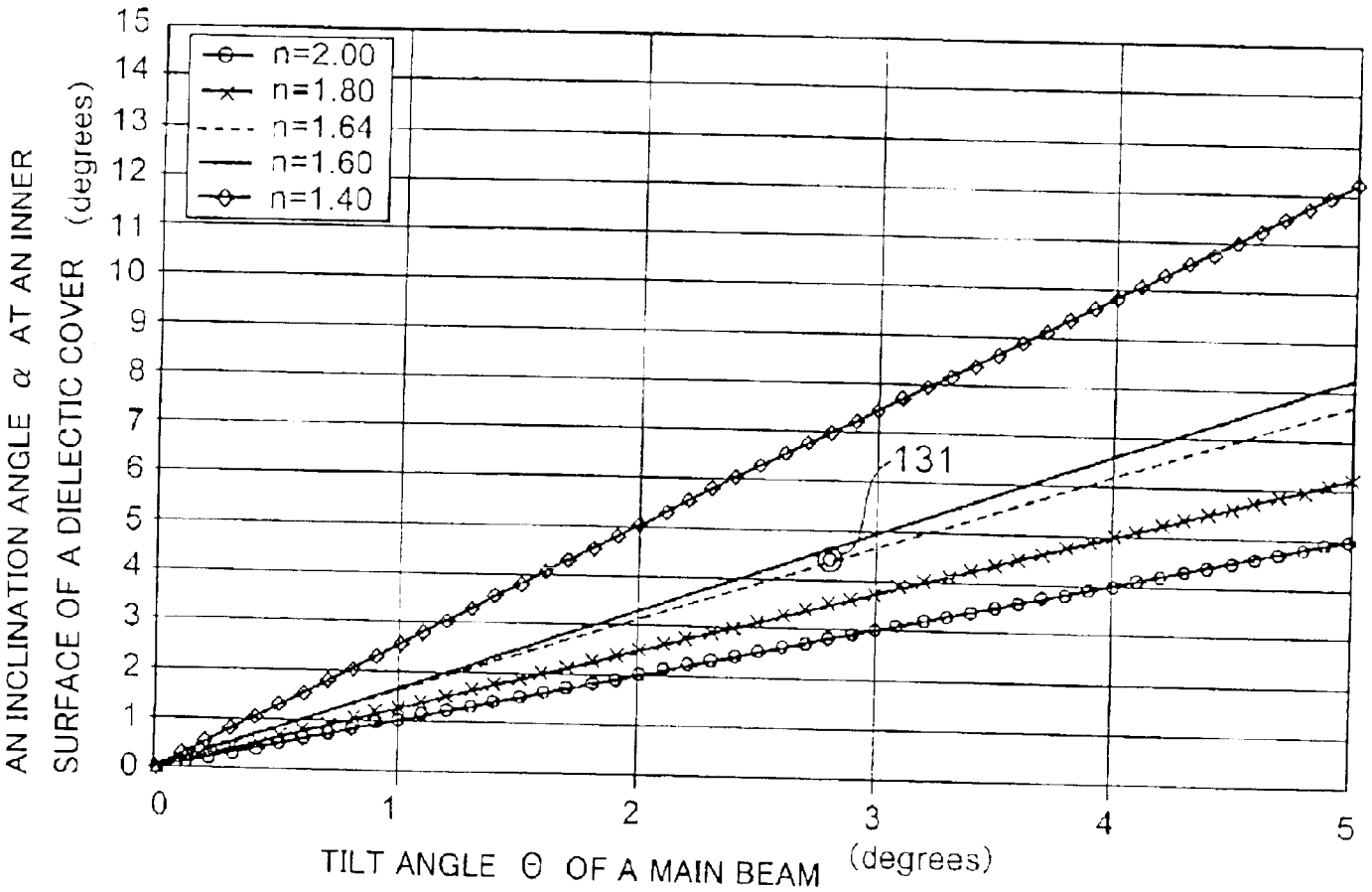
FIG. 14 is a view illustrating a relationship between a tilt angle of a main beam of a slot array antenna and an angle formed by an outer plane of a dielectric cover and an inner plane thereof.

FIG. 14 is a view showing a relationship between a tilt angle $\theta$ of a main beam of a slot array antenna and an angle $\alpha$ formed by an outer plane and an inner plane of a dielectric cover. Characteristics of refractive indexes n=1.4, n=1.6, n=1.64, n=1.8 and n=2.0 are illustrated in FIG. 14. Incidentally, a point 131 where n=1.64 is a position where the relationship between $\theta$ and $\alpha$ employed in the first and second embodiments is represented. It is understood as is apparent from FIG. 14 that as the value of the refractive index n increases, a slight change in the inclination angle $\alpha$ exerts a large influence on the tilt angle. Thus, when the dielectric cover is processed or machined, the more the relative dielectric constant $\in_r$ of the dielectric material or the refractive index n of the electromagnetic wave increases, the more the high accuracy of processing of the inclination angle $\alpha$ is required. It is desirable that the value of the refractive index n is practically less than or equal to about 2.

In the slot array antennas according to the first and second embodiments, the electromagnetic wave radiated from the slot plate of the regular or ordinary slot array antenna is refracted by the dielectric cover. With a view toward describing this operation in detail, the present operation is divided into the operation of a slot array antenna main body and the refraction of the electromagnetic wave by the dielectric cover, and the operations of the slot array antennas according to the first and second embodiments will be explained.

The operation of the slot array antenna main body will first be described using FIG. 5.

An outward appearance of the slot array antenna main body 200 is represented as shown in FIG. 5. When an electromagnetic wave is fed from a feed port 204 of the slot array antenna main body 200, the electromagnetic wave passes through feed waveguides so as to be fed to their corresponding radiating waveguides. Further, the electromagnetic wave fed to each of the radiating waveguides is radiated from each of slot elements 203 of a slot plate. In the process of allowing the electromagnetic wave to pass through the feed waveguides and radiating waveguides lying inside the slot array antenna main body 200, power of the electromagnetic waves fed to the respective slot elements are adjusted so as to follow a predetermined distribution (e.g., Taylor distribution, uniform distribution). Accordingly, the radiating power concentrates on the main beam of the radiation directivity to thereby obtain a high radiation efficiency. The more the radiation efficiency increase, the more the radiating electromagnetic wave gets farther.

The refraction of the radiated electromagnetic wave by the dielectric cover will next be described.

Figure 15:
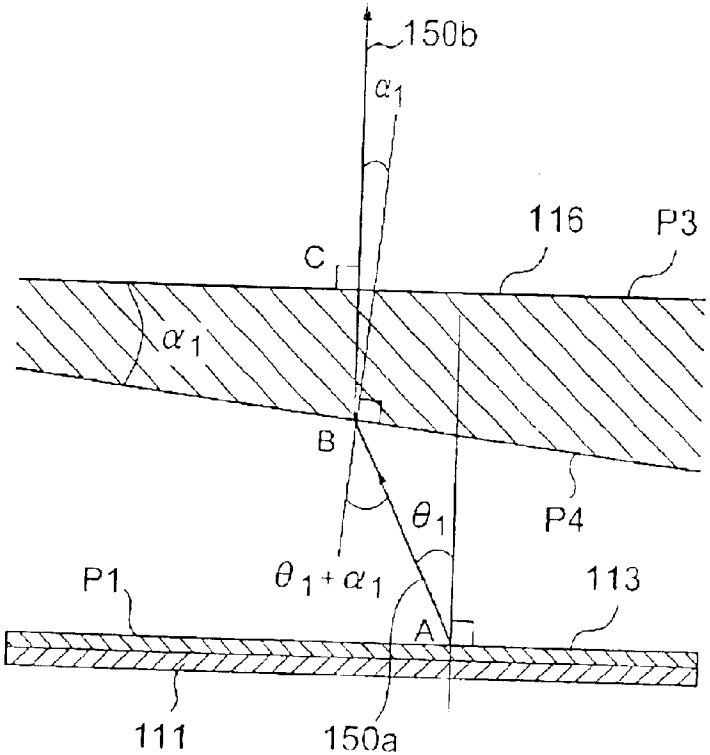
FIG. 15 is a view depicting a propagation path (where a main beam of the radiation pattern of a slot array antenna is tilted to the feed port side of the radiation waveguide) of a radiating electromagnetic wave on inner and outer planes of a dielectric cover.

FIG. 15 is a view depicting a propagation path of a radiating electromagnetic wave on inner and outer planes of a dielectric cover. FIG. 15 shows a case in which a main beam of the radiation pattern of a slot array antenna is tilted to the feed port side (the left side in the drawing) of a radiating waveguide. FIG. 15 can be recognized to be a partly enlarged view of FIG. 1. Thus, the same portions as those in FIG. 1 are identified by the same reference numerals and their description will therefore be omitted.

In FIG. 15, a point A is one point on the surface of a slot plate 113. A main beam of the radiation pattern is considered to be radiated from the point A, and the direction thereof is illustrated in the drawing. Since the antenna can be generally regarded as one point if it is seen from a sufficient distance, a start point of the main beam having the radiation directivity is considered to be the point A, and main beams 150*a* and 150*b* can hence be considered as one light beam. Since a tilt angle of the main beam 150*a* is $\theta_1$, the angle between the main beam 150*a* and the normal to a plane P1 of the slot plate 113 results in $\theta_1$. The main beam 150*a* intersects an inner plate P4 of a dielectric cover 116 at a point B. Since a dielectric material for the dielectric cover 116 has a relative dielectric constant $\in_r$, it also has a refractive index n as represented by the equation (1). In a manner similar to light, the main beam 150*a* is refracted in accordance with Snell's law at the point B and changes in direction. Since the post-refraction main beam 150*b* is considered like one light beam, it intersects an outer plane P3 of the dielectric cover 116 at right angle at a point C.

Since the main beam 150*b* extends in the direction (i.e., the direction vertical to the plane P1 of the slot plate 113) normal to the outer plane P3 of the dielectric cover 116, it propagates far off as it is without changing the direction of the main beam 150*b* even if it passes through the dielectric cover 116 and goes out. Under such a condition, an inclination angle $\alpha_1$ of the inner plane P4 with respect to the outer plane P3 of the dielectric cover 116 is determined. As shown in FIG. 15, the normal to the inner plane P4 of the dielectric cover 116 is represented with the angle formed with the main beam 150*b* as $\theta_1+\alpha_1$ and the angle formed with the post-refraction main beam 150*b* as $\alpha_1$. According to Snell's law, the following equation is established:

$$\sin(\theta_1+\alpha_1)=n \sin \alpha_1 \tag{5}$$

Solving the equation (5) yields the equation (2).

Thus, the direction of the main beam 150*b* becomes perpendicular to the outer plane P3 of the dielectric cover 116 and the plane P1 of the slot plate 113 due to the refraction of the main beam by the inner plane P4 of the dielectric cover 116. Accordingly, if the antenna is taken as the slot array antenna with the dielectric cover 116 mounted thereto, then the tilt angle $\theta_1$ reaches substantially zero. In the case of the slot array antenna main body, however, the tilt angle $\theta_1$ of the main beam exists, and a broad band can be maintained without a change in antenna's frequency band.

Figure 16:
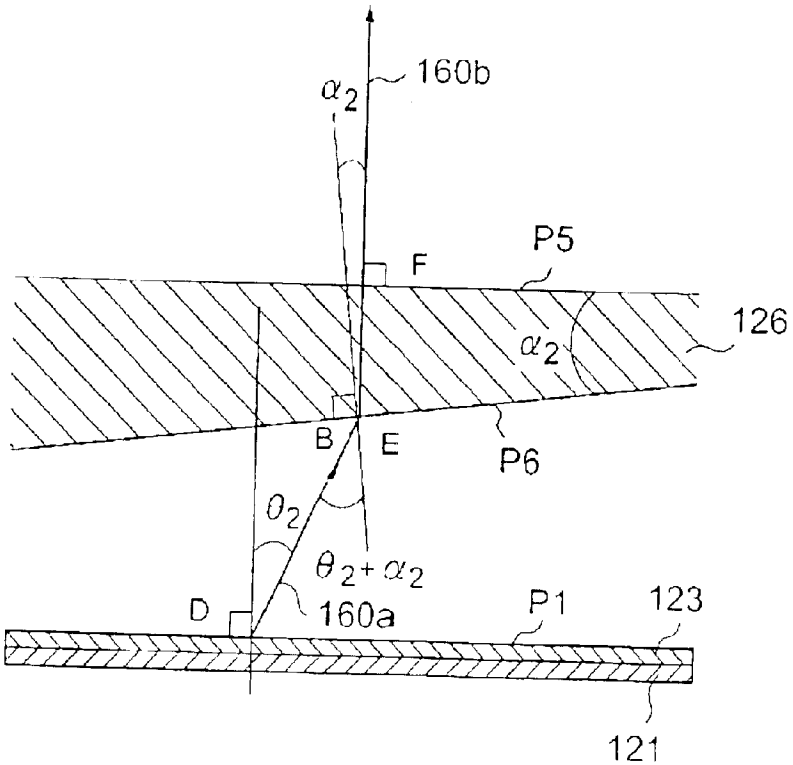
FIG. 16 is a view showing a propagation path (where a main beam of the radiation pattern of a slot array antenna is tilted to the side opposite to a feed port of the radiation waveguide) of a radiating electromagnetic wave on inner and outer planes of a dielectric cover.

FIG. 16 is a view showing a propagation path of a radiating electromagnetic wave on an inner plane and an outer plane of a dielectric cover. FIG. 16 shows a case in which a main beam of the radiation pattern of a slot array antenna is tilted to the side (right side in the drawing) opposite to a feed port of a radiating waveguide. FIG. 16 can be recognized to be a partly enlarged view of FIG. 11. Thus, the same portions as those in FIG. 1 are identified by the same reference numerals and their description will therefore be omitted.

In FIG. 16, a point D is one point on the surface of a slot plate 123. A main beam of the radiation pattern is considered to be radiated from the point D, and the direction thereof is illustrated in the drawing. In a manner similar to FIG. 15, main beams 160*a* and 160*b* can be considered as one light beam. Since a tilt angle of the main beam 160*a* is $\theta_2$, the angle between the main beam 160*a* and the normal to a plane P1 of the slot plate 123 results in $\theta_2$. The main beam 160*a* intersects an inner plate P6 of a dielectric cover 126 at a point E. Since a dielectric material for the dielectric cover 126 has a relative dielectric constant $\in_r$, it also has a refractive index n as represented by the equation (1). In a manner similar to FIG. 15, the main beam 160*a* is refracted in accordance with Snell's law at the point E and changes in direction. The post-refraction main beam 160*b* intersects an outer plane P5 of the dielectric cover 126 at right angles at a point F.

Since the main beam 160*b* extends in the direction (i.e., the direction vertical to the plane P1 of the slot plate 123) normal to the outer plane P5 of the dielectric cover 126, the direction of the main beam 160*b* remains unchanged even if it passes through the dielectric cover 126 and comes out. Under such a condition, an inclination angle $\alpha_2$ of the inner plane P6 with respect to the outer plane P5 of the dielectric cover 126 is determined.

There is a need to set the accuracy of processing of an angle $\alpha$ formed by the outer plane and the inner plane of the dielectric cover according to the present invention to 0.1° or less in order to correct the main beam of the slot array antenna to the direct front (the direction normal to the plane P1) of the antenna as described above. It is however difficult to maintain such high accuracy when the slot array antennas are mass-produced. Even though the high accuracy of processing could be achieved, a reduction in cost cannot be realized. However, if an angular variation in the main beam of the slot array antenna, which has passed through the dielectric cover employed in the present invention, can be limited to within an allowable angular range as viewed from the direct front of the antenna even if the angle $\alpha$ varies due to deterioration in the accuracy of processing of the dielectric cover, it falls within an allowable range as the slot array antenna, and the mass production of slot array antennas low in cost is also enabled. Therefore, it is necessary to manifest the relationship between the variation in the angle $\alpha$ due to the processing accuracy of the dielectric cover and the tilt angle $\theta$ of the main beam of the slot array antenna.

Figure 17:
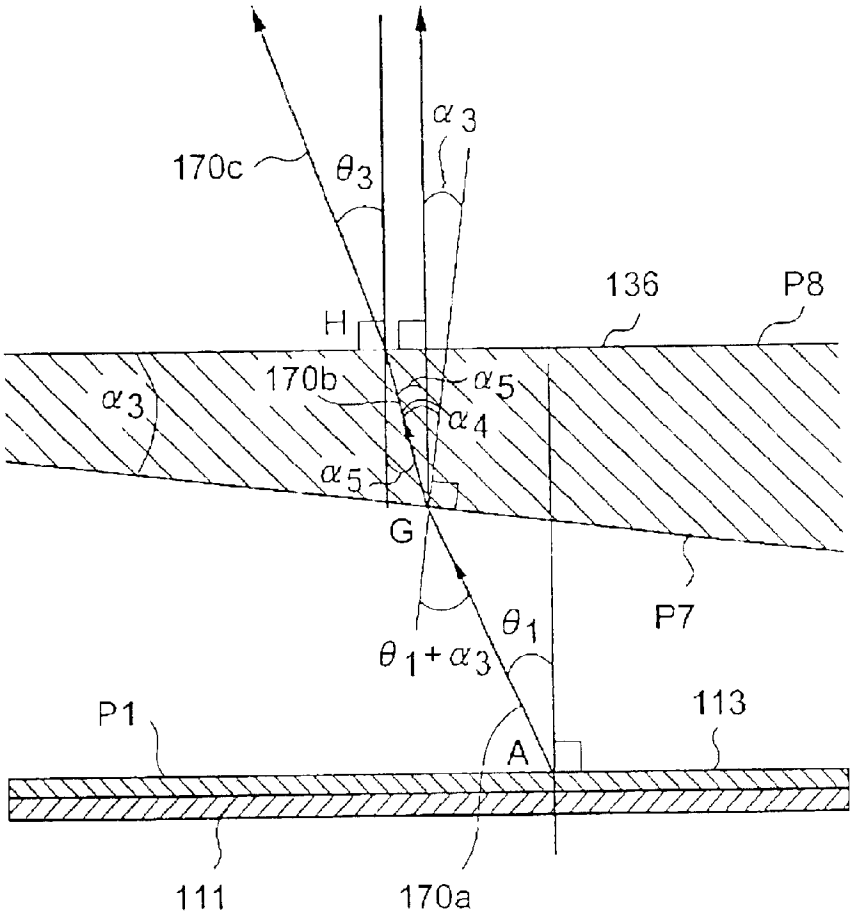
FIG. 17 is a view illustrating a propagation path (where a main beam of the radiation pattern of a slot array antenna is radiated aslant from an outer plane of a dielectric cover) of a radiating electromagnetic wave on inner and outer planes of the dielectric cover.

FIG. 17 is a view showing a propagation path of a radiating electromagnetic wave where an angle formed by an inner plane and an outer plane of a dielectric cover is $\alpha_3$. FIG. 17 shows a case in which a main beam of the radiation pattern of a slot array antenna is tilted to the feed port side (the left side in the drawing) of a radiating waveguide. The drawing can be regarded as a view in which the angle $\alpha_1$ shown in FIG. 15 is brought to the angle $\alpha_3$ due to variations in the processing accuracy of the dielectric cover. In FIG. 17, the same portions as those in FIG. 15 are thus identified by the same reference numerals, and the description thereof will therefore be omitted.

As described above, the angle of inclination of the inner plane P7 to the outer plane P8 of the dielectric cover 136 in FIG. 17 is given as $\alpha_3$. If the inclination angle $\alpha_3$ is equal to such $\alpha_1$ as expressed in the aforementioned equation (2), then the main beam 150*b* of the slot array antenna, which has passed through the dielectric cover 116, is made normal to the outer plane P3 of the dielectric cover 116 as shown in FIG. 15, so that the main beam 150*b* of the slot array antenna is seemed to radiate from the direct front of the slot array antenna. Since, however, the inclination angle of the dielectric cover 136 in FIG. 17 is $\alpha_3$ other than $\alpha_1$, the main beam radiated from the outer plane P8 of the dielectric cover 136 has a tilt angle $\theta_3$ which is not normal to the plane P8 but made from its vertical direction.

A main beam 170*a* having radiation directivity is radiated with an inclination of an angle $\theta_1$ from a point A of a slot plate 113 of a slot array antenna 111 as viewed from the vertical direction in a manner similar to FIG. 15. The main beam 170*a* having the radiation directivity is launched into a point G of the inner plane P7 of the dielectric cover 136. The normal to the point G on the plane P7 is represented so that the angle which the normal forms with the main beam 170*a* of the radiation directivity, is given as $\theta_1+\alpha_3$ and the angle which the normal forms with the post-refraction main beam 170*b*, is given as $\alpha_4$. According to Snell's law, the relationship among these angles $\theta_1$, $\alpha_3$, and $\alpha_4$ is established as follows:

$$\sin(\theta_1+\alpha_3)=n \sin \alpha_4 \tag{6}$$

The post-refraction main beam 170*b* reaches a point H on the outer plane P8 of the dielectric cover 136 through the point G on the inner plane P7 of the dielectric cover 136. A line (vertical line) normal to the outer plane P8 and the post-refraction main beam 170*b* form an angle (inclination angle) $\alpha_5$. This angle $\alpha_5$ is equal to $\alpha_4-\alpha_3$.

$$\alpha_5=\alpha_4-\alpha_3 \tag{7}$$

Further, the post-refraction main beam 170*b* intersects the outer plane P8 of the dielectric cover 136 at the point H. The angle that the main beam 170*b* forms with the normal to the outer plane P8 of the dielectric cover 136, results in $\alpha_5$. Furthermore, when the post-refraction main beam 170*b* passes through the point H, followed by refraction, and it goes out of the dielectric cover 136, the main beam 170*b* results in a main beam 170*c*. The angle (tilt angle) formed between the main beam 170*c* and the perpendicular at the point H results in $\theta_3$. According to Snell's law, the following equation is established:

$$\sin \theta_3=n \sin \alpha_5 \tag{8}$$

Deriving the tilt angle $\theta_3$ using the equations (6), (7) and (8) yields the following equation (9).

$$\theta_3=\arcsin \{\sin(\theta_1+\alpha_3)\cos \alpha_3-\sin \alpha_3\sqrt{n^2-\sin^2(\theta_1+\alpha_3)}\} \tag{9}$$

Figure 18:
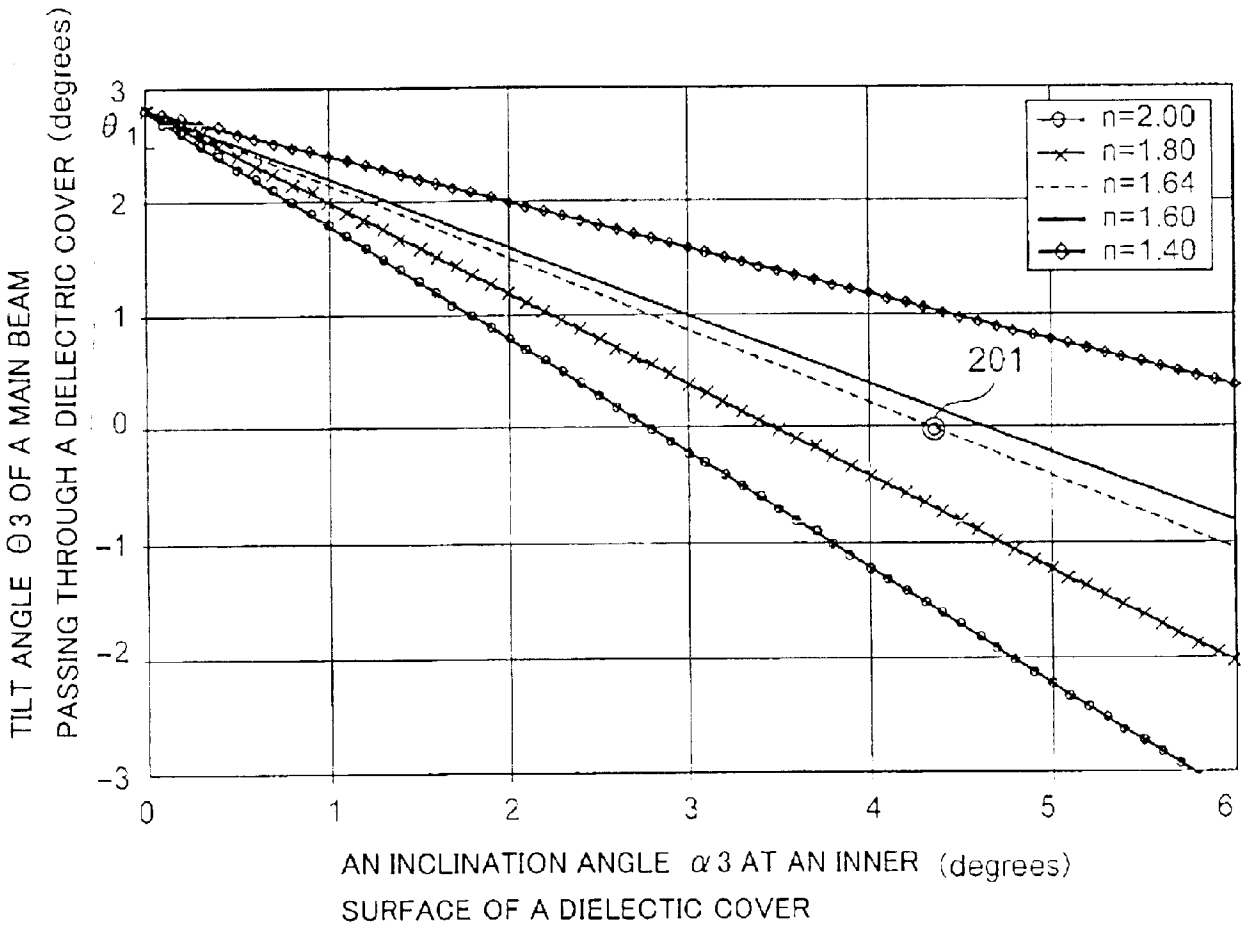
FIG. 18 is a view showing a relationship between a tilt angle of a main beam of a slot array antenna and an angle formed by an outer and an inner planes of a dielectric cover employed therein.

FIG. 18 is a characteristic diagram showing the equation (9) in graph form. The refractive index n of the dielectric cover 136 is used as a parameter in a manner similar to FIG. 14. When the tilt angle $\theta_3$ is brought to 0, the main beam 170*c* becomes vertical to the outer plane P8 of the dielectric cover 136 and hence the main beam 170*c* is radiated from right in front of the antenna. On the other hand, when the inclination angle $\alpha_3$ is 0, $\theta_3=\theta_1$ and hence the tilt angle of the main beam of the antenna is not corrected.

When the inclination angle $\alpha_3$ reaches 4.36° where the refractive index n is 1.64, for example, in FIG. 18, the tilt angle $\theta_3$ equals to 0. The coordinates of a point 201 show a position in the above-described case. If the inclination angle $\alpha_3$ corresponding to an X coordinate of the point 201 varies within a range of about 20%, then the value of the tilt angle $\theta_3$ corresponding to its Y coordinate varies within a range of about 0.5°. If variations in tilt angle $\theta_3$ slightly differ according to the refractive index n but falls within a range of, for example, 2 or less corresponding to the value of a practical refractive index n, then the tilt angle $\theta_3$ varies within the range of about 0.5° when the inclination angle $\alpha_3$ varies within a range of about 20% as seen from the zero value of the tile angle $\theta_3$. The variation range of the tilt angle $\theta_3$ falls within about 20% as counted from the value of the practical tilt angle $\theta_1$ and is equivalent to the same degree as an error developed upon antenna installation. Thus, the variation range of the tilt angle $\theta_3$ falls within an allowable range when the antenna is installated normaly.

Figure 19:
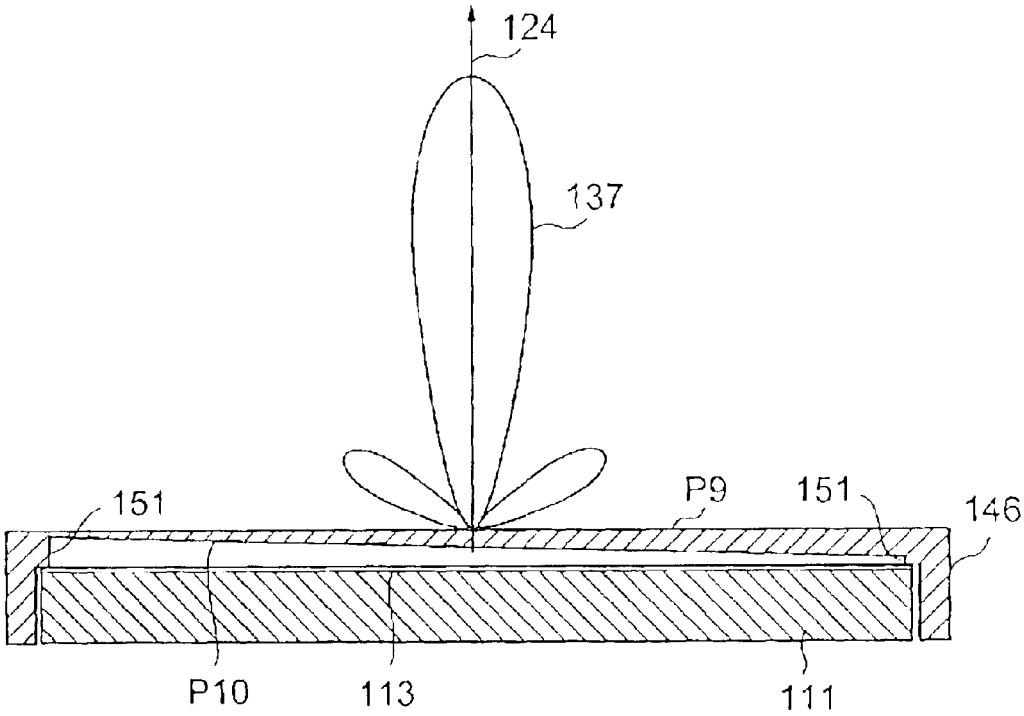
FIG. 19 is a view showing a third embodiment of the present invention.

A main beam refracting process and its variations where a main beam of a slot array antenna is tilted to the feed port side (the left side as seen in the drawing), were described in FIG. 19. However, even when the main beam is tilted to the side opposite to the feed port, a main beam refracting process and its variations are analogous to above. Since they can be described similarly if the explanations using FIG. 16 are used, their description will be omitted. If the accuracy of processing the angle $\alpha_3$ of inclination of the inner plane P7 to the outer plane P8 of the dielectric cover 136 falls within a range of 20% in either case, then the main beam 170*c* of the slot array antenna, which has passed through the dielectric cover 136, varies within a range falling within about 0.5° from the direct front of the antenna. In order to allow the main beam to fall within such a range, there is a need to limit a variation in the value of a practical tilt angle to within a range of about 20%.

Thus, when the dielectric covers 136 are mass-produced in consideration of the variation in the tilt angle $\theta_3$ of such a main beam, the accuracy of processing the angle $\alpha_3$ of inclination of the inner plane P7 to the outer plane P8 may be set to within a range of 20%. Namely, the variation range of the inclination angle $\alpha_3$ may be placed between 0.8 times the value thereof and 1.2 times the value with the value calculated from the equation (4) as the center.

FIG. 19 is a view showing a third embodiment of the present invention. FIG. 19 illustrates a state in which a dielectric cover 146 is mounted to the slot plate side of a slot array antenna 111. The dielectric cover 146 has columnar or wall-shaped posts 151 provided at the corners formed there-inside. Since the posts 151 are brought into direct contact with the corresponding slot plate 113 of the slot array antenna 111 when the dielectric cover 146 is mounted onto the slot array antenna 111, the value of an angle of inclination of an inner plane P10 of the dielectric cover 146 to an outer plane P9 thereof can be always stabilized.

Figure 20:
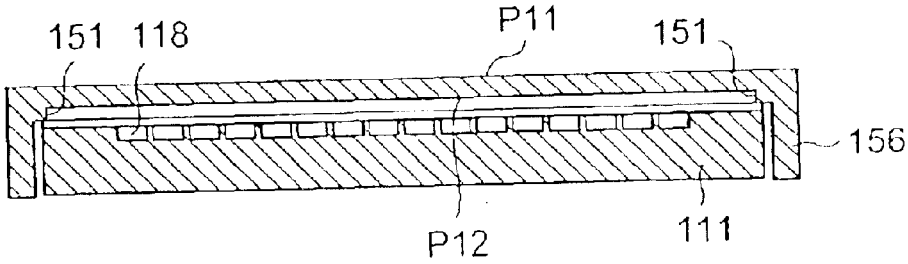
FIG. 20 is a cross-sectional view showing a slot array antenna according to the third embodiment of the present invention and a dielectric cover employed therein, which view includes cross section of radiation waveguides.

FIG. 20 is a cross-sectional view showing the slot array antenna 111 according to the third embodiment of the present invention and a dielectric cover 156, which view includes cross sections of radiating waveguides. While an outer plane P11 and an inner plane P12 of the dielectric cover 156 seems to be parallel in FIG. 20, the inner plane P12 has a predetermined angle inclined to the outer plane P11 along the axis of each radiating waveguide as shown in FIG. 19 in practice. Incidentally, a method of determining an inclination angle is similar to the first and second embodiments and the description thereof will therefore be omitted.

As described above, each of the first through third embodiments has such an inclination angle that the tilt angle of the main beam having the radiation directivity is restrained by the dielectric cover. However, it is also considered that the dielectric cover is fabricated in advance as one having inclination angles ranging from 0° to 20° in 0.5°-increments or so without calculating its inclination angle from the tilt angle of the main beam of the radiation directivity of the slot array antenna, the refractive index of the material for the dielectric cover, etc. By doing so, the angle of the main beam having the radiation directivity may be also adjusted by selecting the dielectric cover after the installation of the slot array antenna main body.

The slot array antenna of the present invention is suitable for millimeter wave communications and used as antennas for an ETC and an ITS. If the number of slot elements of the slot array antenna is increased, then radiation gain becomes higher and the width of the main beam becomes sharp. Accordingly, the slot array antenna can be used even in a system that needs a high gain antenna like a parabola antenna. As applications, may be mentioned, for example, a relay antenna for a telephone communication base station, a relay antenna for a television base station, a satellite communication antenna, a radio astronomy antenna, etc.

A planar antenna such as a Patch Array Antenna, a Radial Line Slot Antenna or the like, or an aperture plane antenna such as a Parabola Antenna, a Horn Antenna or the like has relatively high radiation gain as compared with other antennas and is suitable for use in a frequency band ranging from a band of several hundreds of MHz to a band of several tens of GHz. Since these antennas have main beams each having sharp radiation directivity, it is so difficult to match the direction of each main beam with a desired direction when they are actually used as transmitting/receiving antennas. If the main beam is perfectly normal to the plane of a radiating area or surface of each antenna or an opening surface or plane thereof, then the matching of the transmitting and receiving directions of the antenna is slightly simplified. However, the main beam is not necessarily rendered normal to the plane of the radiating surface of the antenna or the opening surface thereof according to convenience of antenna design and convenience of fixing and installation of the antenna. Namely, there may be cases in which the tilt angle of the main beam is naturally produced according to the above convenience.

While the dielectric cover employed in the present invention has been described to correct the tilt angle of the main beam of the slot array antenna, it is needless to say that the dielectric cover can be applied even to a planar antenna and an aperture antenna whose both main beams have tilt angles, and is capable of bringing out similar effects.

As described above, a slot array antenna of the present invention is provided with a dielectric cover on a slot plate to correct a tilt angle of a main beam of the radiation pattern. In order to broaden a frequency bandwidth, the main beam having the radiation directivity of the slot array antenna must be set so as to have the tilt angle. According to the present invention, however, the transmitting/receiving directions of the antenna can be corrected so as to become orthogonal to the slot plate while the tilt angle is being provided in the main beam having the radiation directivity of the slot array antenna. Thus, when the slot array antenna of the present invention is mounted to a transmitter-receiver, it eliminates not only needless space but also the need for adjustments to the direction of the main beam of the antenna and is capable of providing great contributions to a reduction in the size and cost of communications equipment.

If a low-loss and chemically-stable material like Teflon (trade name) is used as a material for the dielectric cover, then the slot plate of the antenna is protected from dust, stains, shock and contamination produced from chemical substances. Accordingly, since a radome provided to protect the slot plate of the antenna becomes unnecessary, a further reduction in cost can be realized.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. A slot array antenna comprising:

a slot array antenna main body to which a main beam of the radiation pattern, extending in a direction inclined only a tilt angle θ from a direction normal to the plane of a slot plate is set; and a dielectric cover including a dielectric material having a refractive index n, said dielectric cover having an outer plane disposed substantially parallel to the plane of the slot plate, and an inner plane forming an inclination angle α with the outer plane;

wherein the inner plane of said dielectric cover is provided so as to oppose to the slot plat of said slot array antenna main body, so that the main beam having the radiation directivity is transmitted through and refracted by said dielectric cover, whereby the tilt angle θ is corrected to allow the main beam to extend in a direction normal to the outer plane of said dielectric cover.

2. The slot array antenna according to claim 1, wherein the inclination angle α is nearly equal to a value calculated by the following equation (i):

$$\alpha = \arctan\{\sin\theta/(n-\cos\theta)\} \quad \text{(i)}$$

3. The slot array antenna according to claim 1, wherein the inclination angle α is nearly equal to a value calculated within a range of 0.8× arctan {sin θ/(n−cos θ)} to 1.2× arctan {sin θ/(n−cos θ)}.

4. The slot array antenna according to claim 1, wherein said dielectric cover has a protrusion which contacts the slot plate and stably fixes said dielectric cover.

5. The slot array antenna according to claim 1, wherein said slot array antenna main body has a feed port for an input/output electromagnetic wave within a plane normal to the slot plate, and the main beam having the radiation directivity is tilted to the feed port side by the tilt angle θ.

6. The slot array antenna according to claim 1, wherein said slot array antenna main body has a feed port for an input/output electromagnetic wave within a plane normal to the slot plate, and the main beam having the radiation directivity is tilted to the side opposite to the feed port by the tilt angle θ.

7. The slot array antenna according to claim 1, wherein said slot array antenna main body has radiating waveguides into which the electromagnetic wave inputted from the feed port is introduced, and the inner plane of said dielectric cover is tilted along the longitudinal direction of said each radiating waveguide.

8. A method of adjusting a direction of a main beam of the radiation pattern of a slot array antenna, comprising the steps of:

preparing a slot array antenna main body to which the main beam of the radiation pattern, extending in a direction inclined only a tilt angle θ from a direction normal to the plane of a slot plate is set;

preparing a plurality of dielectric covers each comprised of a dielectric material having a refractive index n, and wherein each of outer planes is disposed substantially parallel to the plane of the slot plate, and inclination angles formed by the outer planes and inner planes are made different by predetermined angles;

fixing and installing the slot array antenna main body; and placing the inner plane of one selected from said plurality of dielectric covers so as to oppose to the slot plate of the slot array antenna main body to thereby transmit the main beam having the radiation directivity through the dielectric cover and refract the same thereby, thus correcting the tilt angle θ to adjust the main beam in a direction optional to the outer plane of said dielectric cover.

9. The method according to claim 8, wherein when the inclination angle is given as α, the inclination angle is nearly equal to a value calculated by the following equation (ii):

$$\alpha=\arctan\{\sin\theta/(n-\cos\theta)\} \quad \text{(ii)}$$

10. The method according to claim 8, wherein when the inclination angle is represented as α, the inclination angle α is nearly equal to a value calculated within a range of 0.8× arctan {sin θ/(n−cos θ)} to 1.2× arctan {sin θ/(n−cos θ)}.

11. The method according to claim 8, wherein said dielectric cover has a protrusion which contacts the slot plate and stably fixes said dielectric cover.

12. The method according to claim 8, wherein said slot array antenna main body has a feed port for an input/output electromagnetic wave within a plane normal to the slot plate, and the main beam having the radiation directivity is tilted to the feed port side by the tilt angle θ.

13. The method according to claim 8, wherein said slot array antenna main body has a feed port for an input/output electromagnetic wave within a plane normal to the slot plate, and the main beam having the radiation directivity is tilted to the side opposite to the feed port by the tilt angle θ.

14. The method according to claim 12, wherein said slot array antenna main body has radiating waveguides into which the electromagnetic wave inputted from the feed port is introduced, and the inner plane of said dielectric cover is tilted along the longitudinal direction of said each radiating waveguide.

15. The method according to claim 13, wherein said slot array antenna main body has radiating waveguides into which the electromagnetic wave inputted from the feed port is introduced, and the inner plane of said dielectric cover is tilted along the longitudinal direction of said each radiating waveguide.

16. A planar antenna comprising:

a planar antenna main body to which a main beam of the radiation pattern, extending in a direction inclined only a tilt angle θ from a direction normal to an antenna plane is set; and a dielectric cover including a dielectric material having a refractive index n, said dielectric cover having an outer plane disposed substantially parallel to the antenna plane, and an inner plane forming an inclination angle α with the outer plane;

wherein the inner plane of said dielectric cover is provided so as to oppose to the antenna plane of said planar antenna, so that the main beam having the radiation directivity is transmitted through and refracted by said dielectric cover, whereby the tilt angle θ is corrected to allow the main beam to extend in a direction normal to the outer plane of said dielectric cover.

17. The planar antenna according to claim 16, wherein the inclination angle α is nearly equal to a value calculated by the following equation (iii):

$$\alpha=\arctan\{\sin\theta/(n-\cos\theta)\} \quad \text{(iii)}$$

18. The planar antenna according to claim 16, wherein the inclination angle α is nearly equal to a value calculated within a range of 0.8× arctan {sin θ/(n−cos θ)} to 1.2× arctan {sin θ/(n−cos θ)}.

19. The planar antenna according to claim 16, wherein said dielectric cover has a protrusion which contacts the antenna plane and stably fixes said dielectric cover.

20. An aperture antenna comprising:

an aperture antenna main body having an aperture plane or a surface equivalent to the aperture plane and to which a main beam of the radiation pattern, extending in a direction tilted by a tilt angle θ from a direction normal to the aperture plane or the surface is set; and a dielectric cover including a dielectric material having a refractive index n, said dielectric cover having an outer plane disposed substantially parallel to the aperture plane or the surface, and an inner plane forming an inclination angle α with the outer plane;

wherein the inner plane of said dielectric cover is provided so as to oppose to the aperture plane or surface of the aperture antenna main body, so that the main beam having the radiation directivity is transmitted through and refracted by said dielectric cover, whereby the tilt angle θ is corrected to allow the main beam to extend in a direction normal to the outer plane of said dielectric cover.

21. The aperture antenna according to claim 20, wherein the inclination angle α is nearly equal to a value calculated by the following equation (iv):

$$\alpha=\arctan\{\sin\theta/(n-\cos\theta)\} \quad \text{(iv)}$$

22. The aperture antenna according to claim 20, wherein the inclination angle α is nearly equal to a value calculated within a range of 0.8× arctan {sin θ/(n−cos θ)} to 1.2× arctan {sin θ/(n−cos θ)}.

* * * * *